United States Patent [19]

Hodler

[11] 3,964,539

[45] June 22, 1976

[54] PRESSURE DIE CASTING APPARATUS PROVIDED WITH A PRESSURE ATTENUATING DEVICE

[76] Inventor: Fritz Hodler, Chemin du Chatagny 3, CH 1842 Montreux-Territet, Switzerland

[22] Filed: June 4, 1975

[21] Appl. No.: 583,664

[30] Foreign Application Priority Data

June 21, 1974 Germany.....2429920

[52] U.S. Cl...... 164/303; 249/82

[51] Int. Cl.[2]..... B22D 17/32

[58] Field of Search ..... 164/303, 341, 137, 304, 164/305, 410; 249/82; 425/420, 812

[56] References Cited

UNITED STATES PATENTS 2,134,829 11/1938 McWane..... 249/82

FOREIGN PATENTS OR APPLICATIONS 1,138,892 10/1962 Germany

*Primary Examiner*—Ronald J. Shore
*Assistant Examiner*—Gus T. Hampilos
*Attorney, Agent, or Firm*—Hill, Gross, Simpson, Van Santen, Steadman, Chiara & Simpson

[57] ABSTRACT

A pressure die-casting block, wherein two block halves are assembled together along a plane defining a parting plane of the blocks and provide an internal cavity for performing a die-casting operation. The block is provided with a device for attenuating pressure forces which arise during the casting operation, the device being disposed in one of the block halves and acting in the parting plane of the block.

5 Claims, 7 Drawing Figures

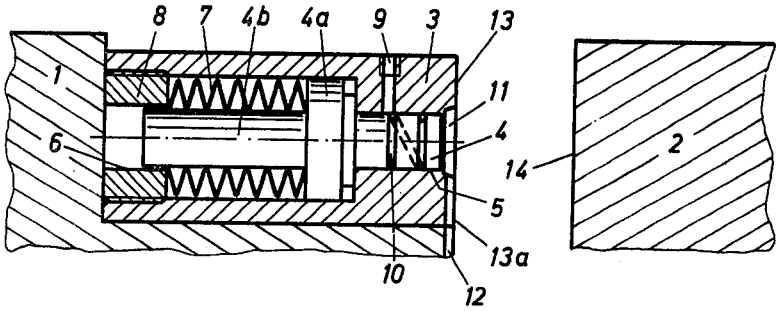
Fig. 1
PRIOR ART
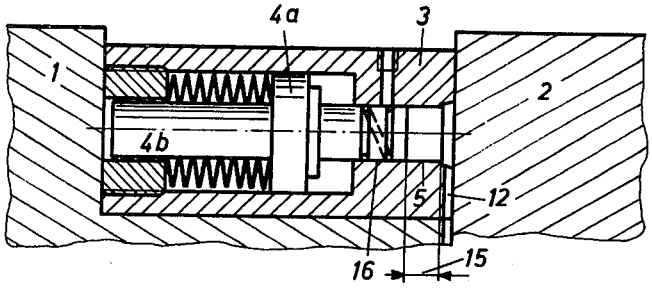
Fig. 2
PRIOR ART
Fig. 3
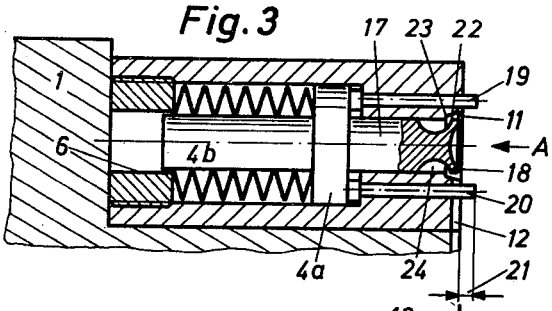
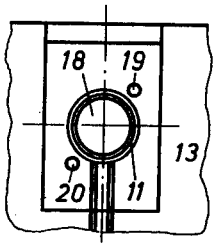
Fig. 4
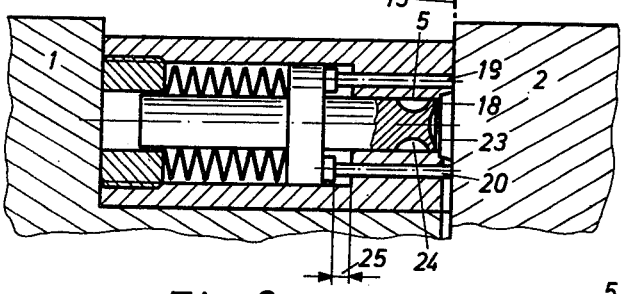
Fig. 5
Fig. 6
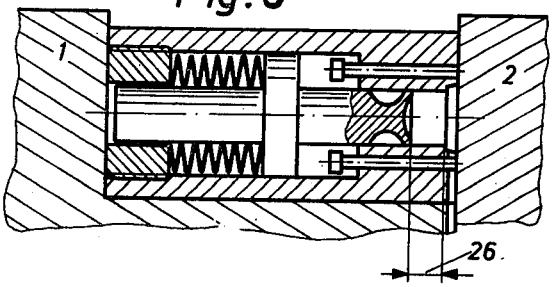
Fig. 7
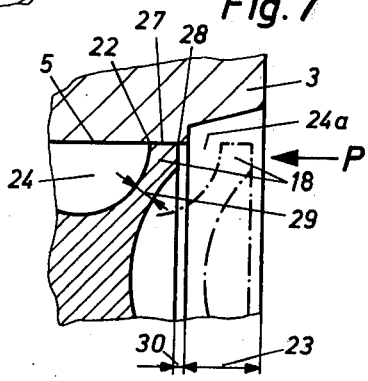

PRESSURE DIE CASTING APPARATUS PROVIDED WITH A PRESSURE ATTENUATING DEVICE

The invention relates to a die-casting block with a device disposed on one of the block halves for attenuating pressure forces which occur in the block due to pressure surges of the casting metal, said device comprising a piston which can be biased by the casting metal, is slidingly guided in a guide cylinder and is biased by the action of a spring system which absorbs the pressure forces.

Exceptionally high pressure surges occur in the casting metal in pressure die-casting blocks at the end of the filling operation due to the sudden stoppage of the moving masses, such as the plungers with their linkage and working pistons and the liquid casting metal itself, and these pressure surges frequently cause the movable block half to be lifted by a few tenths of a millimetre from the fixed block half after the block cavity is filled with liquid metal, i.e. the halves are "burst apart" so that the casting metal is ejected along the block parting planes of the block halves as a result of which accidents are caused or very costly interruptions of operation occur even if protective devices are provided.

In the initially-mentioned device for preventing the above-described pressure surges in a casting block (see German Patent Specification No. 1,138,892, Claim 8, FIG. 5), the desired attenuation of the pressure forces is ensured only for as long as the piston, which acts on the spring system adapted to operate as damping element, does not jam in its guide cylinder.

The conditions which prevail in pressure die-casting, namely the elevated temperatures and the pressure surges which are exceptionally high although brief, and attain values of up to 3000 kg/cm$^2$, and the high degree of affinity of liquid aluminium for steel, cause the piston of the abovementioned device to jam, frequently after only a few operating hours, the piston therefore no longer moves within its guide cylinder and must be repaired which in turn causes costly interruptions of operation. Moreover, despite the small clearance between the piston and its guide cylinder, small quantities of metal particles ingress into the gap during each operating cycle and build up in the piston sliding zone of the cylinder which leads to a radial pressure which is so high that the piston is no longer able to move, despite the pressure applied to it by the casting metal, and can be removed from its guide cylinder, in the course of the repair which then becomes necessary, only by applying powerful hammer blows. Attempts have been made to eliminate the disadvantages described above by providing the piston with lubricating grooves into which high-temperature-resistant grease is introduced through a connecting duct. A further attempt was made by applying special surface treatment to the piston and its guide. These attempts, however, did not lead to a satisfactory result.

It is therefore the object of the present invention to avoid the above-described disadvantages by adopting a fundamentally different solution for the problem.

According to the invention, the problem is solved in that the piston is provided with a constriction in the region of its crown and the said constriction zone, or at least the crown-side boundary edge thereof, is disengaged from the guide cylinder front edge on the side of the block parting plane and that an operating device is provided which returns the piston into a stand-by position when the block is closed in such a way that the constriction or the crown part formed thereby is completely situated within the guide cylinder and the crown part is preferably situated a few tenths of a millimeter from the front edge of the guide cylinder.

Because of the construction according to the invention one or both of the boundary edges of the restriction zone of the piston and/or the endface of the crown part cause any metal particles (slivers and the like) which may have ingressed into the gap between the wall of the piston and the wall of the guide cylinder to be ejected and any metal particles which have remained on the piston are stripped off when the block is closed due to the reverse motion of the piston into the stand-by position so that jamming of the piston of the kind which occurred in the previously-described known device is reliably avoided. The disengagement, at least of the crown-side boundary edge of the cylinder constriction, renders this accessible so that spraying of the block halves with a lubricant, which takes place prior to each closing of the casting block, also causes the lurbicant to be applied to the free part of the piston and to the wall of the guide cylinder in the constriction zone, the lubricant also penetrating into the gap and thus ensuring low-friction sliding of the piston in the guide cylinder. When the block is closed, the actuating device automatically returns the piston into the stand-by position so that it is in the position corresponding to the beginning of the attenuation stroke if pressure surges of the casting metal occur.

In a particularly advantageous further embodiment of the invention, the crown part of the cylinder adjoining the constriction zone is so constructed, for example in the form of a lip-shaped, resilient edge zone, that the diameter of the crown part is enlarged when it is biased with pressure. This construction provides particularly good sealing between the crown part of the piston and the guide cylinder and reliably prevents the ingress of foreign particles into the sliding zone of the piston so that the above-described harmful effects of any such ingress are avoided.

Further advantageous embodiments of the subject of the invention are disclosed in the other Claims and in the description hereinbelow of one embodiment of the invention which is illustrated in the accompanying drawing, in which:

FIG. I is a section through a pressure die-casting block with a known damping device with the block shown in an open position.

FIG. II shows the arrangement according to FIG. I with the block in a closed position after a damping stroke of the damping device, FIG. III is a section through a pressure die-casting block showing one embodiment of a damping device according to the invention in the position corresponding to the open position of the block, FIG. IV shows the arrangement of FIG. III as seen in the direction A, FIG. V is a section of the system according to FIG. III with the casting block in the closed position, FIG. VI shows the arrangement according to FIG. V after the damping stroke of the damping device, FIG. VII is an enlarged section of part of a embodiment according to the invention.

Corresponding parts in the illustrations have the same reference numerals.

FIG. I shows a section through a die-casting block provided with a known damping device with the block in an open position. One block half 1 and an other block half 2 form the die-casting block. The known damping device disposed on the block half 1 comprises a casing 3 with a guide cylinder 5 within which is guided a piston 4 which is the actual damping piston. The piston 4 has a plate spring 4*a* and a spring guide bolt 4*b* the end of which is slidingly guided in a cylindrical guide 6 disposed in a spring retaining screw 8 in order to improve the guiding action of the entire system. A spring 7, in the present case a compression spring, is disposed between the spring retaining screw 8 and the spring plate 4*a* of the piston 4. The piston 4 contains lubricating grooves 10 which are supplied with lubricant through a lubricating duct 9 in the casing 3. The numeral 13*a* refers to a block parting plane of the casing 3, said plane being in flush alignment with a block parting plane 13 of the associated block half 1 and the numeral 14 refers to the block parting plane of the block half 2. On the side of the block parting plane the guide cylinder 5 merges into a circular, conical inlet dish 11 which communicates through a duct 12 with the block cavity (not shown). As already described, in this way the piston 4 can be biased by the casting metal so that the pressure forces which occur as the result of pressure surges of the casting metal can be conducted through the piston to the spring 7 and are thus attenuated.

FIG. II, which shows the arrangement explained hereinabove in accordance with FIG. I but with the block in the closed position and after the damping stroke of the piston 4, shows the damping stroke 15 of the piston 4 while the numeral 16 refers to the sliding zone of the piston 4 within the guide cylinder 5 in which said guiding zone metal particles are deposited and built up in the manner described above to cause the piston to jam.

FIG. III shows one possible embodiment of the system according to the invention. The piston, referenced in this case with the numeral 17, namely the actual damping piston, is provided in its crown region with an annular constriction zone 24 so that the piston 4 is provided with a crown part 18 the detailed construction of which is shown in FIG. VII.

According to FIG. VII, which shows the detailed construction of the crown part 18 of the cylinder 17, the said crown part 18 is relatively short and constructed in the form of a dish to produced a lip-shaped, resilient edge zone the thinnest part of which is designated with the numeral 29. The dish-shaped crown part 18 bears on the internal wall 27 of the guide cylinder 5 by means of two sharp edges of which the boundary edge nearest to the crown with respect to the constriction 24 is designated with the numeral 22 and the other edge is designated with the numeral 28.

Again referring to FIG. III, an operating device for the piston 4 comprises two operating tappets 19 and 20, disposed coaxially with respect to the piston 4, which project by the length of stroke 21 beyond the block parting plane 13 of their block halves 1 or the block parting plane 13*a* of the casing 3 in alignment therewith when the block is opened. The other end of the operating tappets 19 or 20 bear in the region of the plate spring 4*a* of the piston 4.

FIG. III also discloses that after the block is opened the crown-side boundary edge 22 of the constriction 24 is disengaged from the end of the guide cylinder 4 nearest to the block parting plane so that the said boundary edge 22 is situated above the base 23 of the inlet dish 11. The dish-shaped crown part 18 therefore reliably ejects by means of the sharp edges 22 and 28 any metal particles or other impurities which may have ingressed into the guide cylinder 5. Since the constriction 24 is freely accessible through the annular gap 24*a* thus formed in this position (FIG. VII), the crown-part 18 or the piston 17 and the internal wall of the guide cylinder 5 is thoroughly wetted by the lurbicant mist, thus ensuring low-friction sliding of the piston 17, 18 in the guide cylinder 5.

When the block is closed, the operating tappets are thrust back through the endface of the block half 2 so that the piston 4 is automatically returned into a stand-by position in such a way that the constriction 24 is situated completely within the guide cylinder 5, as shown in FIG. VI. Due to the sharp edges 22 and 28 of the plate-shaped crown part 18 of the piston 17, any metal particles which may have remained are stripped off, thus preventing the ingress thereof into the sliding zone of the piston in the guide cylinder. The numeral 30 in FIG. VII refers to the plunging depth of the crown part 18 of the cylinder 17 as regards the stand-by position. The said plunging depth amounts to 0.1 to 0.3 mm in the case of the closed block. The operating stroke 25 of the operating tappets 19, 20 (FIG. V) corresponds to the return stroke of the piston 17, 18 from its position which corresponds to the open position of the block into the stand-by position.

As may be seen particularly clearly by reference to FIG. VII, the pressure forces which occur at the end of the filling operation and act in the direction of the arrow P on the crown part 18 result in an increase of its diameter, due to its construction, and thus ensure that the edges 22 and 28 bear in particularly tight sealing manner on the internal wall 27 of the guide cylinder 5, thus preventing any ingress of metal particles between the cylinder wall 27 and the piston 17 or its crown part 18.

The numeral 26 in FIG. VII refers to the damping stroke of the piston 17.

I claim:

1. A pressure die casting block comprising two block halves assembled together along a plane defining a parting plane of the blocks to provide an internal cavity for performing a casting operation, a device disposed in one of the block halves for damping pressure forces which occur in the block due to pressure surges during a casting operation, said device having a piston which is slidingly guided in a guide cylinder and biased by the action of a spring system for absorbing the pressure forces, said piston being provided with a constriction in the region of its crown, said constriction being disengageable from the front edge of the guide cylinder nearest to the block parting plane when the block halves are disassembled and by the provision of operating means which return the piston into a stand-by position when the block halves are in the assembled condition so that the constriction is situated completely in the guide cylinder, the crown being retracted by a few tenths of a millimeter from a front edge of the guide cylinder.

2. A pressure die-casting block according to claim 1, wherein a cylindrical short plate-shaped crown part is formed on the piston by the constriction, the said crown part projecting from the guide cylinder when the block is in the disassembled condition.

3. A pressure die-casting block according to claim 2, wherein the crown part of the cylinder adjoining the constriction is constructed in the form of a lip-shaped, resilient edge zone, in such a way that the diameter of the crown part increases when subjected to pressure.

4. A pressure-die casting block according to claim 3, wherein the operating means is provided with at least one operating tappet which is coaxial with respect to the piston and projects beyond the block parting plane of its respective block half when the block halves are disassembled and is actuated by the other block half when the block halves are in the assembled condition thus completely returning the piston into the stand-by position in which the constriction is situated completely within the guide cylinder.

5. A pressure die-casting block according to claim 4, wherein the operating tappet acts on a flange of the piston which also functions as a spring plate.

* * * * *